US008918020B2

(12) United States Patent
Taoka

(10) Patent No.: US 8,918,020 B2
(45) Date of Patent: Dec. 23, 2014

(54) IMAGE FORMING APPARATUS

(71) Applicant: Canon Kabushiki Kaisha, Tokyo (JP)

(72) Inventor: Keitaro Taoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 13/868,927

(22) Filed: Apr. 23, 2013

(65) Prior Publication Data

US 2013/0287420 A1 Oct. 31, 2013

(30) Foreign Application Priority Data

Apr. 27, 2012 (JP) ..... 2012-103805

(51) Int. Cl.
*G03G 15/16* (2006.01)
*G03G 21/16* (2006.01)
*G03G 15/00* (2006.01)

(52) U.S. Cl.
CPC ..... *G03G 15/16* (2013.01); *G03G 21/168* (2013.01); *G03G 2215/00945* (2013.01); *G03G 15/6564* (2013.01); *G03G 2215/00721* (2013.01); *G03G 15/165* (2013.01)
USPC ..... 399/121

(58) Field of Classification Search
CPC ..... G03G 21/168; G03G 2221/1642
USPC ..... 399/121, 124
See application file for complete search history.

(56) References Cited

U.S. PATENT DOCUMENTS

| | | | | |
|---|---|---|---|---|
| 7,039,337 | B2 * | 5/2006 | Kawaguchi et al. | 399/90 |
| 7,706,734 | B2 * | 4/2010 | Higashimura et al. | 399/316 |
| 2002/0150407 | A1 | 10/2002 | Ishiwata | |
| 2005/0242493 | A1 | 11/2005 | Agata | |
| 2008/0038004 | A1 | 2/2008 | Inoue | |
| 2009/0080948 | A1 | 3/2009 | Takei | |
| 2012/0099896 | A1 * | 4/2012 | Kamano | 399/121 |

FOREIGN PATENT DOCUMENTS

| | | | |
|---|---|---|---|
| JP | 5-142906 | A | 6/1993 |
| JP | 2000-122438 | A | 4/2000 |
| JP | 2001-117465 | A | 4/2001 |

* cited by examiner

*Primary Examiner* — Gregory H Curran
(74) *Attorney, Agent, or Firm* — Canon U.S.A., Inc. IP Division

(57) ABSTRACT

An image forming apparatus includes a first detection portion at a first guide provided in an image forming unit and a second detection portion at a second guide provided in a unit drawable to the exterior of the image forming apparatus. Since there are many parts in this apparatus, an error in the relative positions of the first and the second detection portions is large. The image forming apparatus includes a lock member configured to lock the unit to an image forming apparatus main body, and a pressure member configured to, when the unit is locked to the image forming apparatus main body, press the first guide and the second guide to each other. As a result, adjustment of the relative positions of the first and the second detection portions is not required at the time of replacement of the unit or the detection portions.

9 Claims, 16 Drawing Sheets

IMAGE FORMING APPARATUS

BACKGROUND OF THE INVENTION

1. Field of the Invention

The present invention relates to an image forming apparatus, such as a copying machine, a facsimile, and a printer.

2. Description of the Related Art

In an image forming apparatus, such as a copying machine, a facsimile, and a printer, a recording material is conveyed to a registration portion to be aligned with an image (referred to as "leading-edge registration", hereinafter).

Recently, however, a demand for higher accuracy of leading-edge registration has been increasing in the market. The leading-edge registration by the registration portion does not always meet the demand for the higher accuracy of leading edge registration.

Accordingly, a detection member for detecting timing at which a recording material passes may be provided at the upstream position of a transfer portion for the recording material in a recording material conveyance direction. Based on the output of the detection member, registration control (referred to as "leading-edge registration control", hereinafter) may be performed at the registration portion by changing the conveyance speed of the recording material.

As the detection member used to perform the leading-edge registration control, it is desirable to use a detection member having high resolution.

In this case, a pair of detection portions including a detection member portion and a prism portion, or a pair of detection portions including a light receiving portion and a light emitting portion may be disposed opposite each other in the recording material conveyance path.

Such a pair of detection portions maybe respectively disposed at a secondary pre-transfer upper guide and a secondary pre-transfer lower guide, which are located in the upstream vicinity of a secondary transfer portion.

Further, for accessibility at the time of sheet jam (referred to as "jam", hereinafter) processing or at the time of maintenance, a secondary pre-transfer lower guide may be mounted on a secondary transfer outer unit, which can be drawn from an apparatus main body.

Japanese Patent Application Laid-Open No. 5-142906 discusses a structure in which a secondary pre-transfer upper guide is provided on a main body side and a secondary pre-transfer lower guide is provided on a drawable unit side, and in which, when the unit is stored, the unit contacts an image forming apparatus so that the position of the unit is set.

However, the structure including a first detection portion disposed at a first guide, a second detection portion disposed at a second guide, and a first guide which is supported by an image forming unit, and a second guide which is disposed at a drawable unit has the following problems.

Since there are many parts in the conventional positioning structure, it is difficult to assure relative positions of the first and the second detecting portions.

The positions of the first and the second detection portions may be assured by adjustment to align the respective positions thereof. However, similar adjustments are also required at the time of replacement of the detection portions or at the time of replacement of the unit. Thus, the operating time for adjustments becomes long and the operating cost therefor becomes high.

SUMMARY OF THE INVENTION

According to an aspect of the present invention, an image forming apparatus includes a first unit configured to transfer a toner image to a recording material at a transfer portion, a feeding member configured to feed the recording material toward the transfer portion, a guide member configured to guide the recording material fed by the feeding member to the transfer portion, the guide member including a first guide provided at the first unit and a second guide provided at a second unit drawable to an exterior of an image forming apparatus main body, the second guide being disposed at a position opposite the first guide and guiding the recording material, a detection member disposed on an upstream side of the transfer portion in a feeding direction of the recording material and configured to detect timing at which the recording material passes, the detection member including a first detection portion provided at the first guide and a second detection portion provided at the second guide, a speed setting member configured to set a conveyance speed of the recording material according to a result of detection by the detection member, a lock member configured to lock the second unit stored in the image forming apparatus at a position within the image forming apparatus main body, and a pressure member configured to press the first guide and the second guide to each other when the second unit is locked within the image forming apparatus main body.

According to an exemplary embodiment of the present invention, an image forming apparatus, which does not require adjustment of the relative positions of a first detection portion and a second detection portion at the time of replacement of a unit or the detection portions, can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and embodiments of the invention will be described in detail below with reference to the drawings.

(Structure of Entire Image Forming Apparatus)

Figure 1:
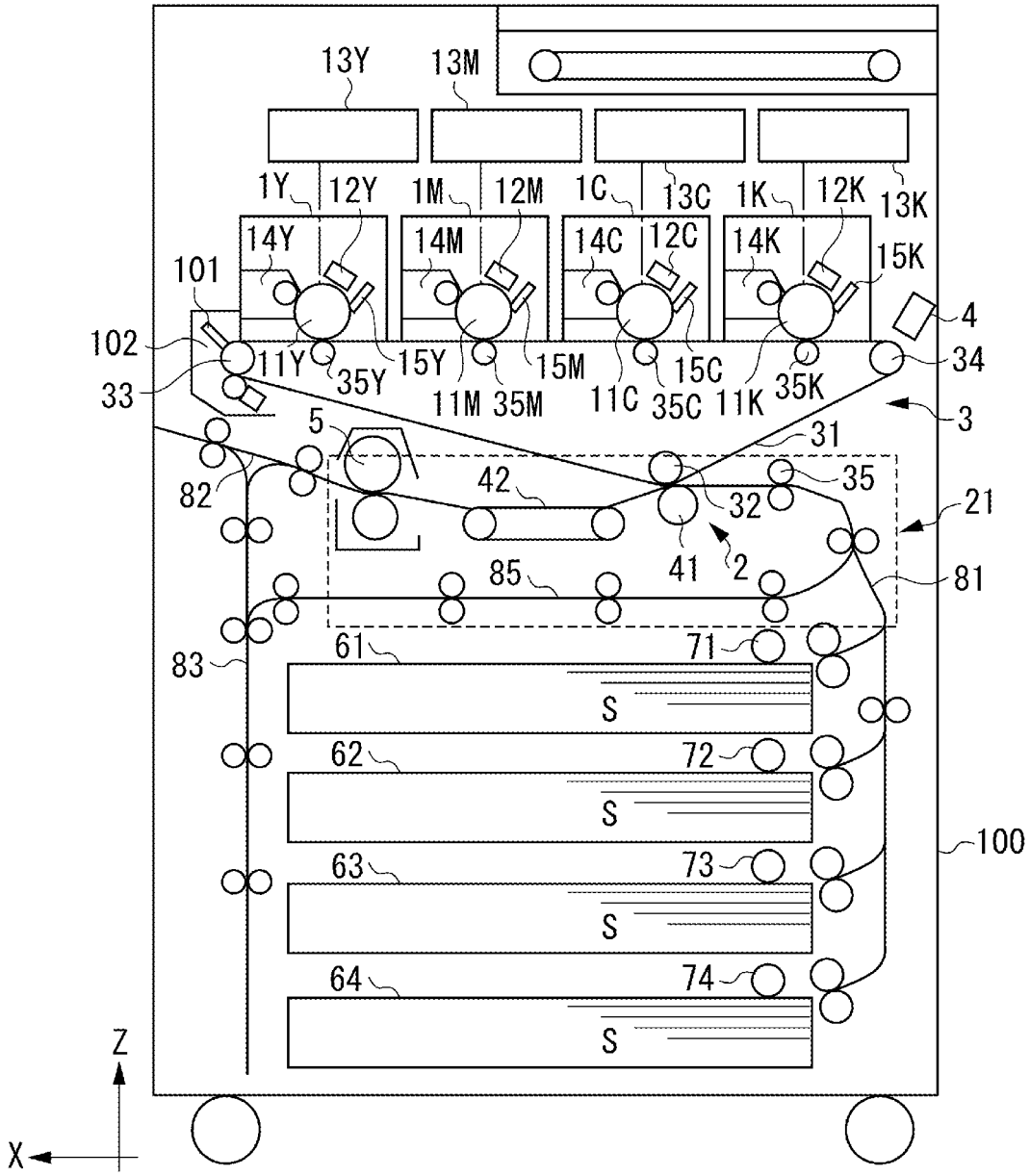
FIG. 1 is a cross-sectional view illustrating an image forming apparatus.

A first exemplary embodiment of the present invention will be described below. FIG. 1 is a schematic cross-sectional view illustrating a color digital printer as a concrete example of an image forming apparatus including a secondary transfer portion (transfer portion) according to the exemplary embodiment of the present invention.

The surfaces of four photosensitive drums 11Y, 11M, 11C, and 11K are uniformly charged by chargers 12Y, 12M, 12C, and 12K, respectively.

Image signals of yellow (Y), magenta (M), cyan (C), and black (K) are input to laser scanners 13Y, 13M, 13C, and 13K, respectively. According to these image signals, the drum surfaces are irradiated with a laser beam and a latent image is formed.

The latent images formed on the photosensitive drums are developed by development devices 14Y, 14M, 14C, and 14K with toners of yellow, magenta, cyan, and black, respectively.

The toners developed on the respective photosensitive drums are sequentially transferred by primary transfer rollers 35Y, 35M, 35C, and 35K to an intermediate transfer belt 31, which is an endless belt-shaped image bearing member. A full-color toner image is formed on the intermediate transfer belt 31.

On the other hand, a sheet material S which is a recording material fed from any of sheet feeding cassettes 61 to 64 is conveyed to a registration roller 75 by sheet feeding pickup rollers 71 to 74 and downstream conveyance rollers thereof.

The toner image is transferred to the sheet material S by a secondary transfer outer roller (a transfer member) 41 and the sheet material 5, to which the toner image is transferred, is transferred and conveyed by a secondary transfer portion 2. Thereafter, the sheet material S is absorbed and conveyed by a pre-fixing conveyance unit 42. The toner image on the sheet material S is heated and pressed by a fixing roller 5 and is fixed onto the sheet material S.

Thereafter, the sheet material S is passed along a sheet discharge conveyance path 82 and discharged to the exterior of an apparatus main body 100. Here, when an image is also formed on a non-image forming side of the sheet material S, the sheet material S passes the fixing roller 5, and then passes along a reversing conveyance path 83 and a double-sided conveyance path 85, and is conveyed to a registration roller 75. The subsequent process is as mentioned before.

(Structure of Secondary Transfer Portion)

Figure 2:
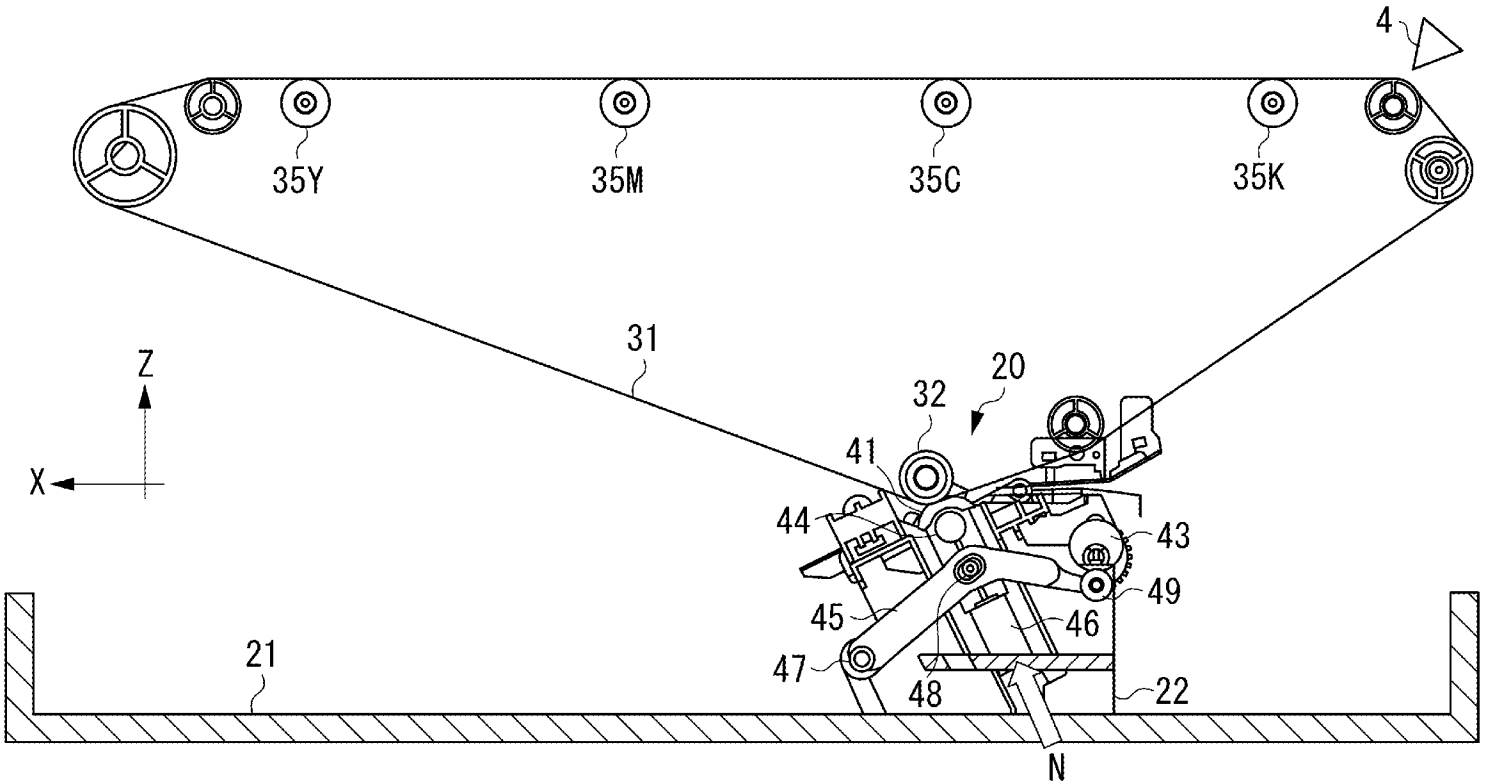
FIG. 2 is a cross-sectional view illustrating an intermediate transfer belt and a secondary transfer portion.

FIG. 2 is a cross-sectional view illustrating an intermediate transfer belt unit and the secondary transfer portion (the transfer portion) 2 according to the present exemplary embodiment. FIG. 2 is a cross-sectional view illustrating the state during an image forming job.

Figure 3:
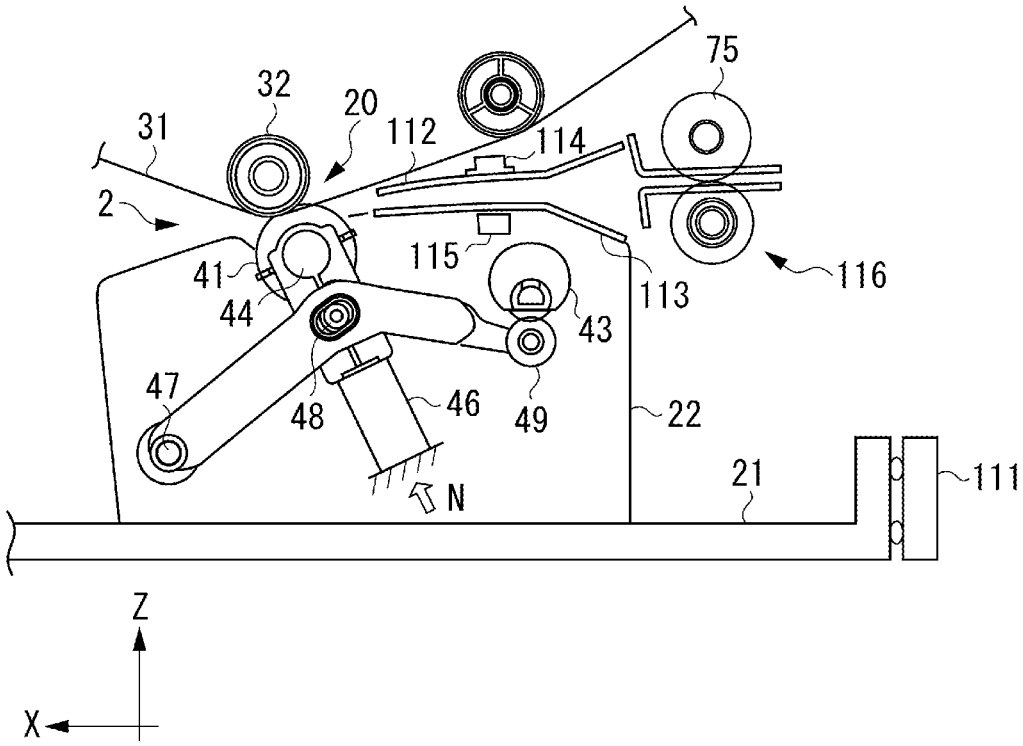
FIG. 3 is a cross-sectional view illustrating a vicinity of the secondary transfer portion.

FIG. 3 is a cross-sectional view mainly illustrating the secondary transfer portion 2 according to the present exemplary embodiment.

As illustrated in FIG. 3, both ends of the secondary transfer outer roller (the transfer roller) 41 are held by a roller holder 44 so that the secondary transfer outer roller 41 is rotatable around a rotational shaft. The roller holder 44 is urged by a pressure member 46, which is a compression spring, in the direction of arrow N. In this way, the secondary transfer outer roller 41 is urged in the direction of arrow N, holds the intermediate transfer belt 31 together with a secondary transfer inner roller 32, and forms a secondary transfer nip 20.

Figure 4B:
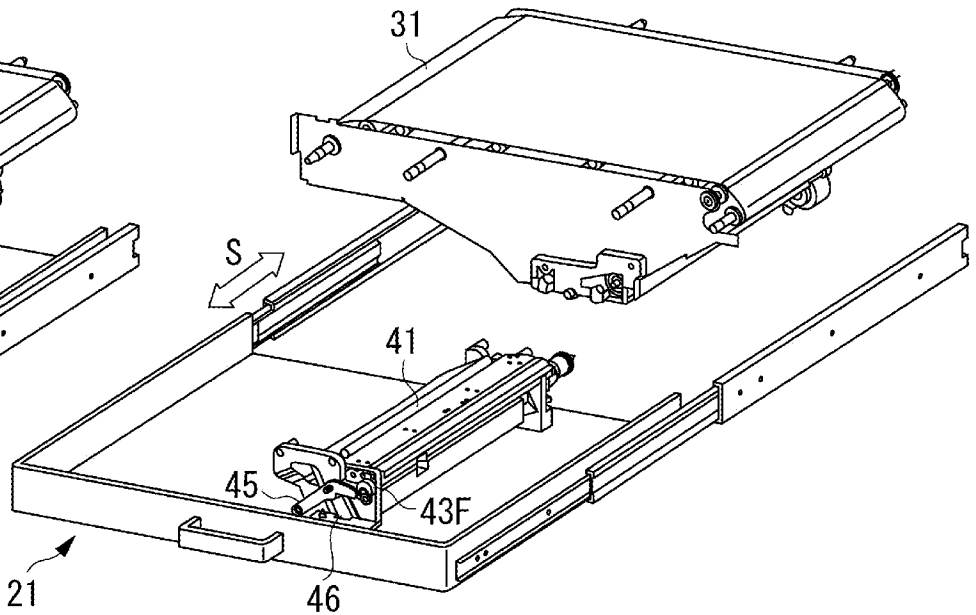
FIGS. 4A and 4B are perspective views illustrating an intermediate transfer belt unit and the secondary transfer portion.
Figure 4A:
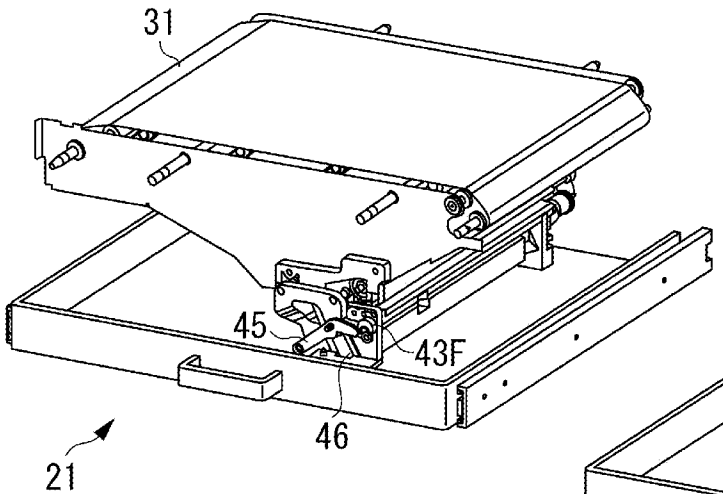

FIGS. 4A and 4B are perspective views illustrating the intermediate transfer belt unit and the secondary transfer portion. FIG. 4A illustrates a state in which a secondary transfer outer unit is mounted on the apparatus main body. FIG. 4B illustrates a state in which a conveyance frame 21 illustrated in FIG. 1 is pulled out in order to access a transfer conveyance portion at the time of jam processing or at the time of maintenance.

The conveyance frame 21 is configured to be able to be pulled out of and pushed into the apparatus main body in the directions of arrows S. By pulling out the conveyance frame 21 in the width direction of the secondary transfer outer roller 41, the secondary transfer outer roller 41 is separated from the intermediate transfer belt 31.

Here, if the secondary transfer outer roller 41 contacts the intermediate transfer belt 31, the intermediate transfer belt 31 may have a problem. Therefore, when the conveyance frame 21 is pulled out, the secondary transfer outer roller 41 is desirably detached from the intermediate transfer belt 31.

As described above, it is desirable that the secondary transfer outer roller 41 is attached to or detached from (referred to as "attached/detached", hereinafter) the intermediate transfer belt 31, depending on the cases of image formation, jam processing, or maintenance. An attachment/detachment mechanism of the secondary transfer outer roller 41 will be described below.

Figure 5:
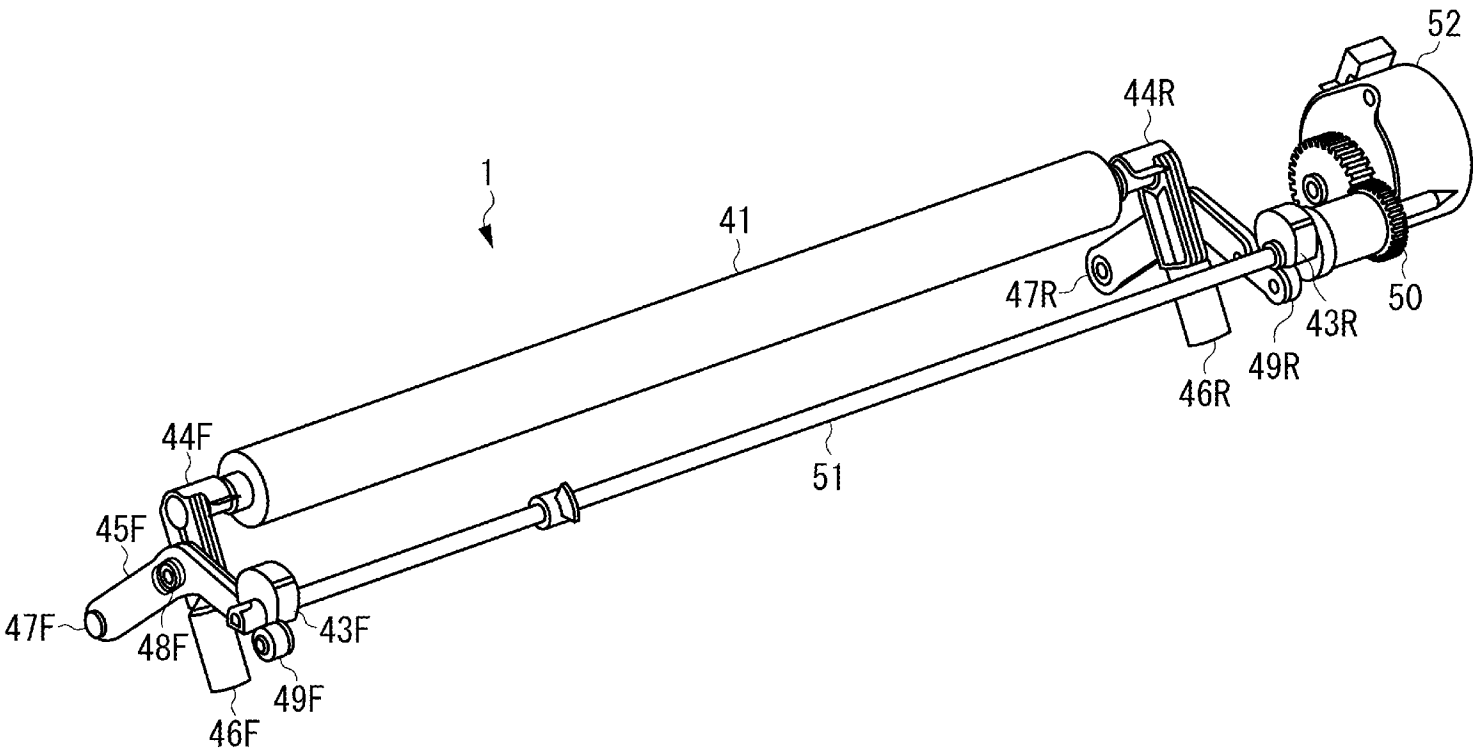
FIG. 5 is a perspective view illustrating a portion relating to a secondary transfer outer roller attachment/detachment mechanism.

FIG. 5 is a perspective view illustrating a portion relating to a secondary transfer outer roller attachment/detachment mechanism of the secondary transfer outer unit 1. As illustrated in FIGS. 3 and 5, the roller holders 44 (44F and 44R) hold the ends of the secondary transfer outer roller 41 and each of the roller holders 44 has an engaging portion 48 which engages with an attachment/detachment arm 45.

The attachment/detachment arm 45 has an attachment/detachment rotational shaft 47 at one end and a cam receiving portion 49 at the other end. The attachment/detachment arm 45 is held to be rotatable around the attachment/detachment rotational shaft 47 which protrudes from a secondary transfer outer frame 22.

Moreover, an attachment/detachment shaft 51 is rotatably held at the secondary transfer outer frame 22. An attachment/detachment cam 43 and an attachment/detachment gear 50 are fixed to the attachment/detachment shaft 51. An attachment/detachment drive motor 52 is provided on the rear side of the image forming apparatus and rotational drive is transmitted from the attachment/detachment drive motor 52 to the attachment/detachment gear 50. As the attachment/detachment gear 50 rotates, the attachment/detachment shaft 51 and the attachment/detachment cam 43 also rotate.

The roller holder 44 is urged to the intermediate transfer belt 31 side by the pressure member 46. Consequently, the attachment/detachment arm 45 engaging with the roller holder 44 is also rotated around the attachment/detachment rotational shaft and urged in the direction of approaching the intermediate transfer belt 31. The cam receiving portion 49 is pressed against the attachment/detachment cam 43. The attachment/detachment cam 43 arbitrarily changes a distance from the attachment/detachment shaft 51 serving as a rotation center to an outer diameter surface of the attachment/detachment cam 43 according to a phase. As the attachment/detachment drive motor 52 rotates the attachment/detachment cam 43 to form an arbitrary phase, the cam receiving portion 49 can be moved.

As a result, the attachment/detachment arm 45 rotates around the attachment/detachment rotational shaft 47, and the roller holder 44 and the secondary transfer outer roller 41 engaged by the engaging portion 48 are moved toward the intermediate transfer belt 31 in the attachment/detachment direction.

In addition, the attachment/detachment cam 43, the roller holder 44, the attachment/detachment arm 45, and the pressure member 46 which are described hereinbefore are disposed on the front side and the rear side of the image forming apparatus. "F" indicates the front side and "R" indicates the rear side.

(Positioning Structure According to the Present Invention)

Description will be given herein of a positioning structure of the secondary transfer outer unit 1 supported by the conveyance frame 21, which is configured to be able to be pulled out of and pushed into the image forming apparatus main body, and an intermediate transfer belt unit 3 supported by the image forming apparatus main body.

Hereafter, the left direction will be "+X direction", the direction from the rear to the front will be "+Y direction", and the upward direction will be "+Z direction". The structure will be described using ±X, Y, and Z directions.

Figure 6A:
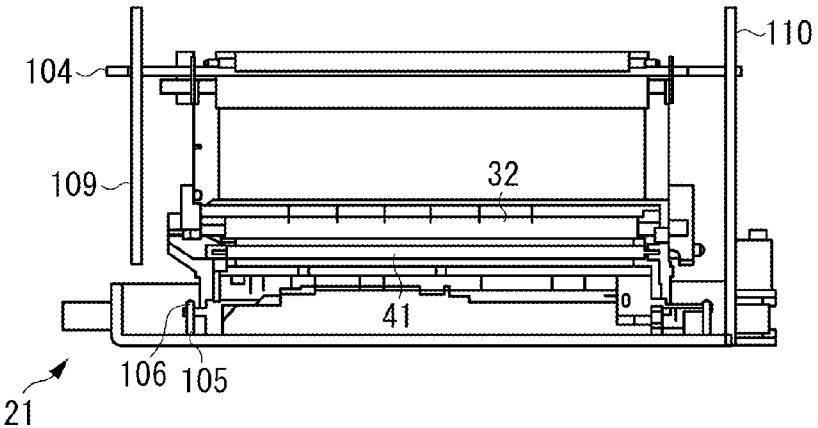
FIG. 6A is a diagram illustrating a state in which a conveyance frame is mounted.
Figure 6B:
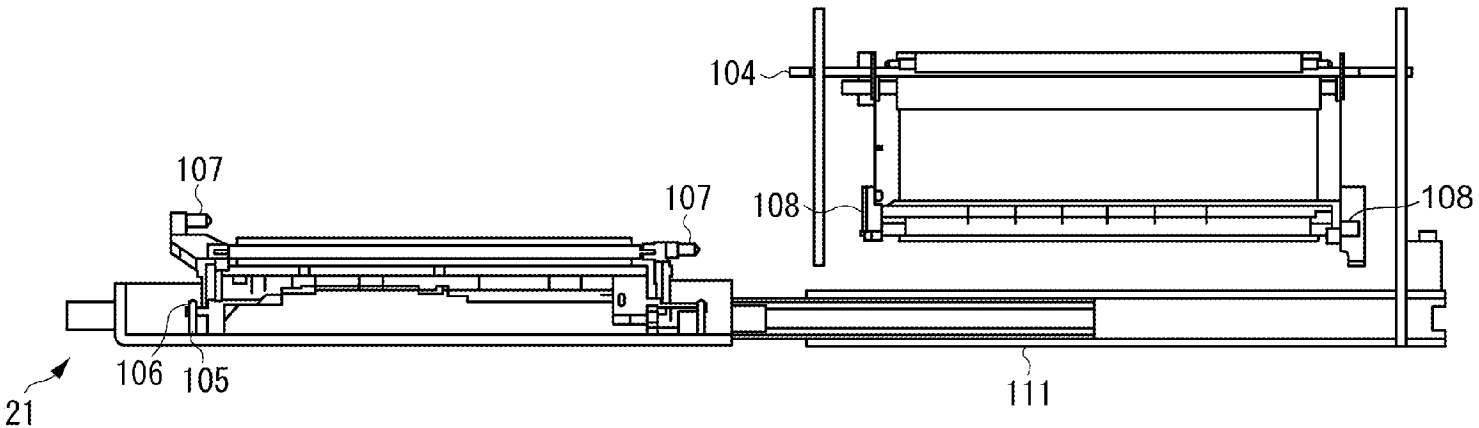
FIG. 6B is a diagram illustrating a state in which the conveyance frame is taken out.
Figure 6B:
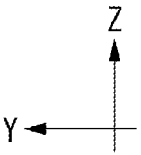
Figure 7A:
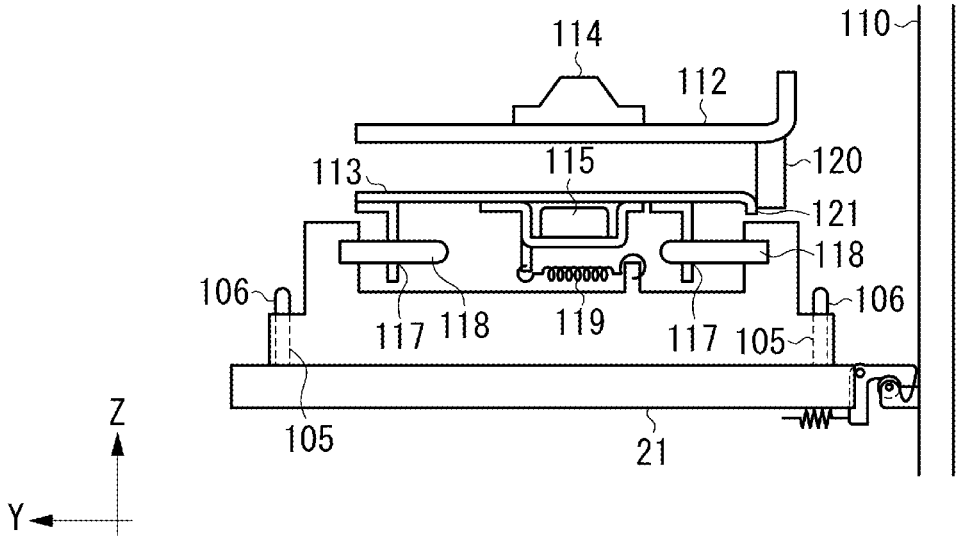
FIGS. 7A and 7B are structural views illustrating a secondary pre-transfer upper guide and a secondary pre-transfer lower guide according to a first exemplary embodiment.
Figure 7B:
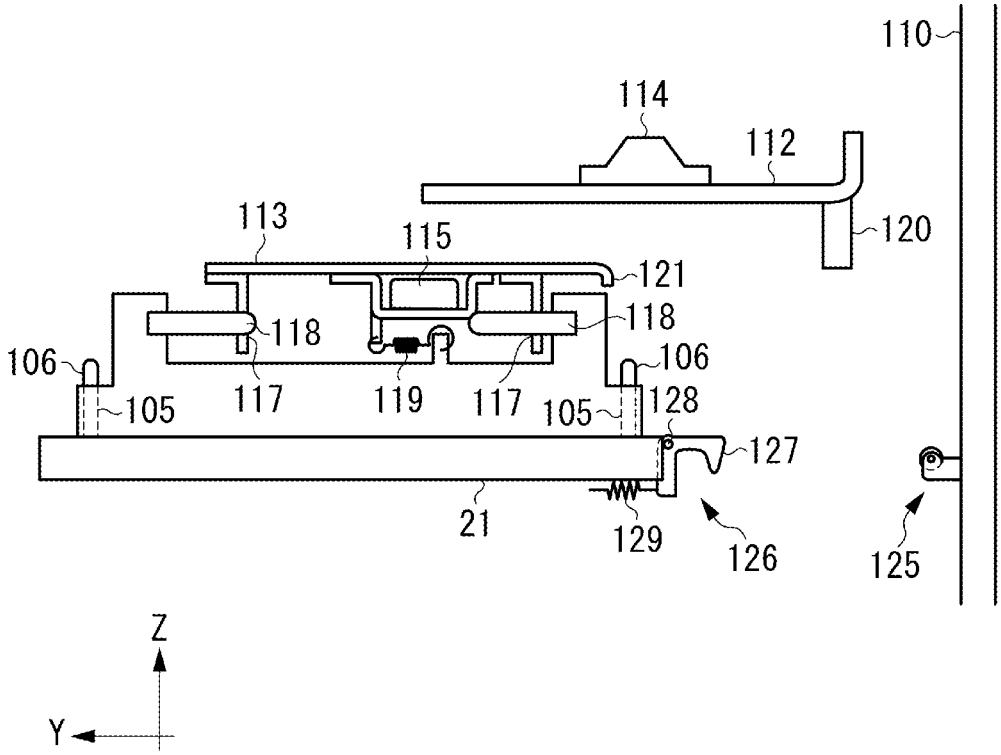

FIGS. 6A and 7A are cross-sectional views, viewed from the X direction, illustrating the intermediate transfer belt and the conveyance frame 21 when the conveyance frame is mounted. FIGS. 6B and 7B are cross-sectional views when the conveyance frame is drawn.

The intermediate transfer belt unit 3 is supported at a front side plate 109 and a rear side plate 110 by two front and rear supporting shafts 104. Thus, the intermediate transfer belt unit 3 is positioned in the X, Y, and Z directions relative to the image forming apparatus.

In the secondary transfer outer unit 1, a conveyance frame protruding portion 105 protruding from the conveyance frame 21 engages with a secondary transfer engaging portion 106 of the secondary transfer outer unit 1. The secondary transfer outer unit 1 in the Y direction relative to the conveyance frame 21 is positioned at the mounted position.

Further, a secondary transfer protruding portion 107 protruding from the secondary transfer outer unit 1 engages with a secondary transfer inner engaging portion 108 of the intermediate transfer belt unit 3. The secondary transfer outer unit 1 is positioned in the X and Z directions relative to the intermediate transfer belt unit 3.

Furthermore, the conveyance frame 21 and the secondary transfer outer unit 1 engaged with the conveyance frame 21 are supported so that, with respect to the image forming apparatus main body, the conveyance frame 21 and the secondary transfer outer unit 1 are able to be pulled out of and pushed into the image forming apparatus main body in the Y direction via a slide rail 111. Then, the conveyance frame 21 and the secondary transfer outer unit 1 which are stored in the image forming apparatus main body are locked in the image forming apparatus main body.

A lock portion provided for the conveyance frame 21 engages with a main body engaging portion of the image forming apparatus main body. Accordingly, the conveyance frame 21 and the secondary transfer outer unit 1 are locked in a state in which the conveyance frame 21 and the secondary transfer outer unit 1 are stored in the image forming apparatus main body.

According to the attachment/detachment structure of the secondary transfer outer roller 41 and the positioning structure described above, to access the secondary transfer portion 2 at the time of jam processing or maintenance, the conveyance frame 21 can be pulled out from the image forming apparatus main body without contacting the intermediate transfer belt 31.

(Description of Arrangement of Detection Member)

An arrangement of a detection member for carrying out leading-edge registration control will be described below.

Figure 8:
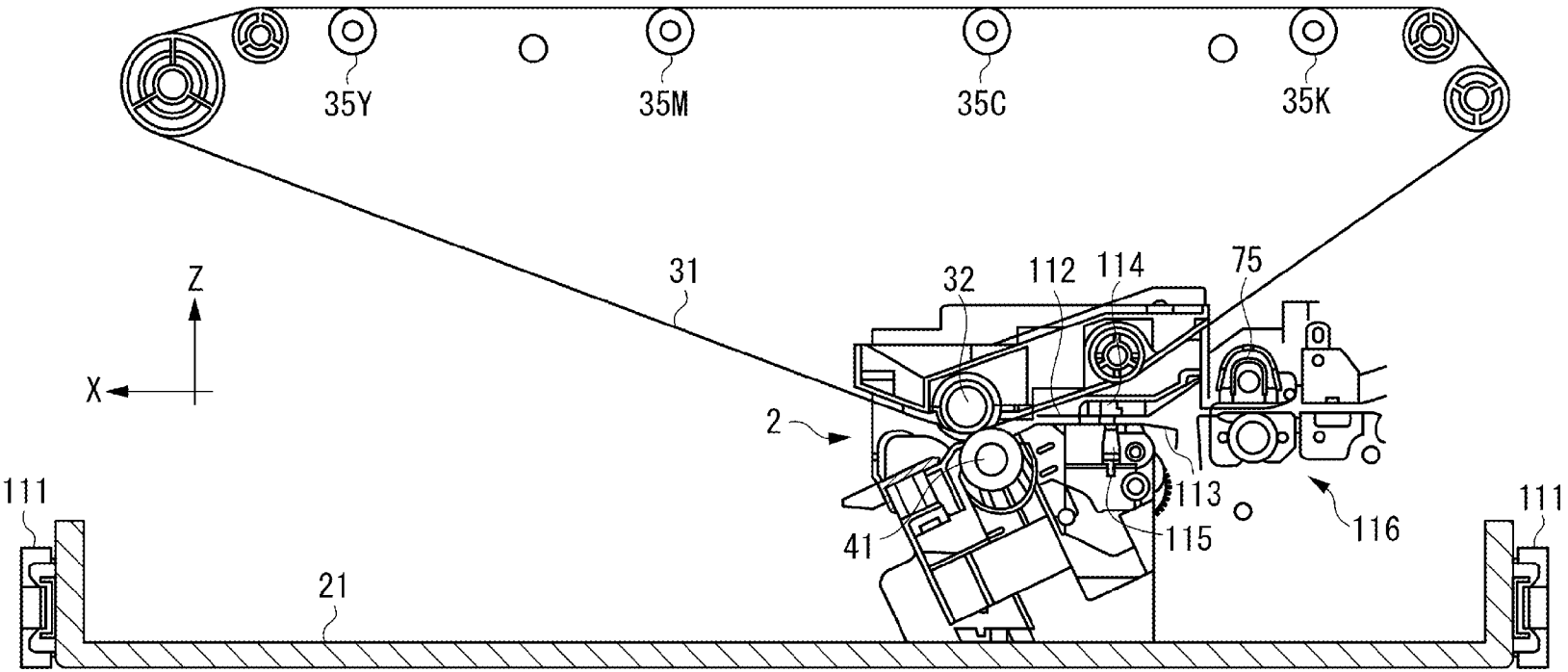
FIG. 8 is a cross-sectional view illustrating a registration portion, the intermediate transfer belt unit, and a secondary transfer outer unit.

FIGS. 8 and 3 are diagrams illustrating a registration portion (a feeding portion) 116 and the secondary transfer portion (the transfer portion) 2.

A guide member is disposed between a recording material conveyance direction downstream side of the registration portion 116 and a recording material conveyance direction upstream side of the secondary transfer portion 2.

The guide member includes a secondary pre-transfer upper guide (a first guide) 112 and a secondary pre-transfer lower guide (a second guide) 113 so that the secondary pre-transfer upper guide 112 and the secondary pre-transfer lower guide 113 oppose each other. A recording material conveyance path is formed by the guide member.

The secondary pre-transfer upper guide 112 is mounted on the intermediate transfer belt unit 3 included in an image forming unit, and the secondary pre-transfer lower guide 113 is mounted on the secondary transfer outer unit 1.

In the present exemplary embodiment, a retroreflective detection member for the leading-edge registration control is used to detect timing at which the recording material passes. A prism portion (a first detection portion) 114 is mounted on the secondary pre-transfer upper guide 112, and a light emitting/receiving portion (s second detection portion) 115 is mounted on the secondary pre-transfer lower guide 113.

Figure 9B:
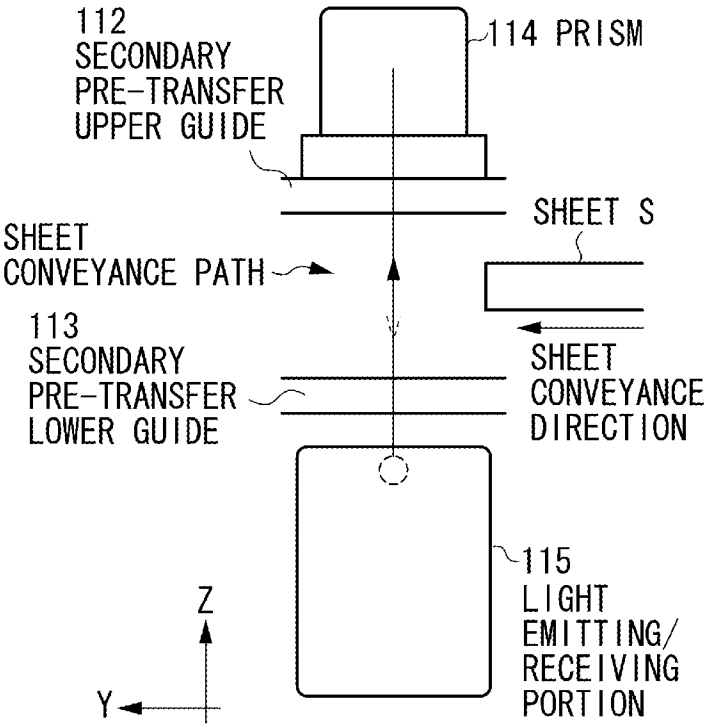
FIGS. 9A and 9B are explanatory diagrams illustrating a retroreflective detection member.
Figure 9A:
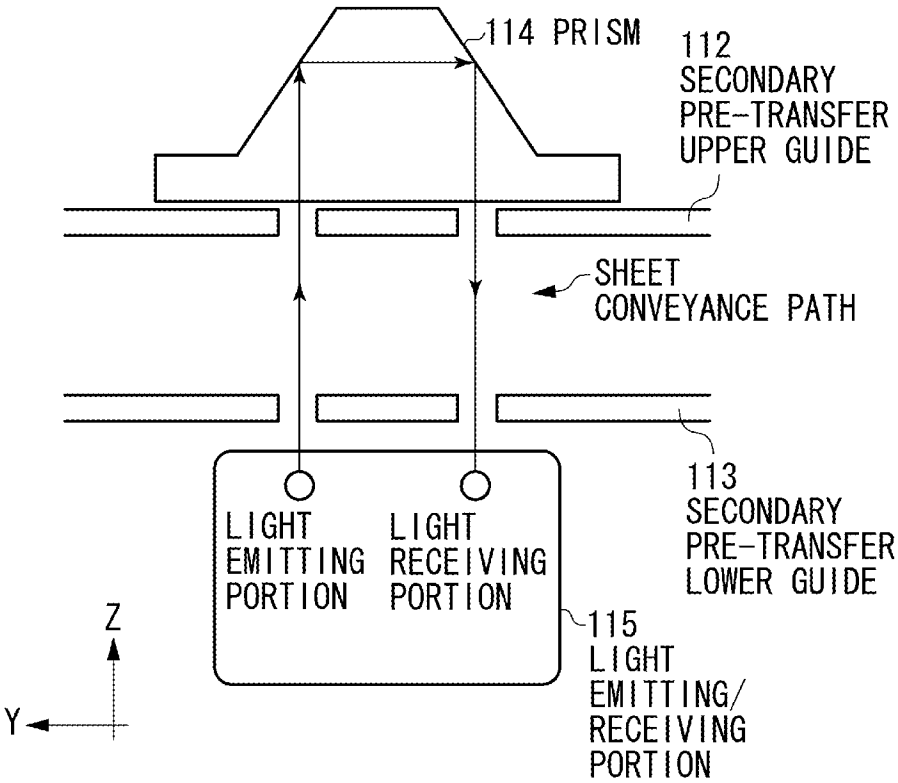

FIGS. 9A and 9B are explanatory diagrams illustrating the retroreflective detection member.

In FIG. 9A, light incident on the prism portion 114 from a light emitting portion of the light emitting/receiving portion 115 goes through an interior of the prism portion and then enters a light receiving portion of the light emitting/receiving portion 115.

In FIG. 9B, the detection member is located so that light is blocked while the sheet S is conveyed from the right direction to the left direction.

Here, the necessary accuracy of relative positions in which the light emitting/receiving portion 115 and the prism portion 114 can detect properly is ±1 mm in all of the X, Y, and Z directions.

In the conventional positioning structure, the accuracy of relative positions in the X direction and the Z direction is ±1 mm. However, because the number of parts for positioning is large in the Y direction, when intersections of the respective parts are accumulated, the accuracy of a relative position in the Y direction is ±2 mm. Accordingly, it was not possible to employ a retroreflective detection member.

Figure 10:
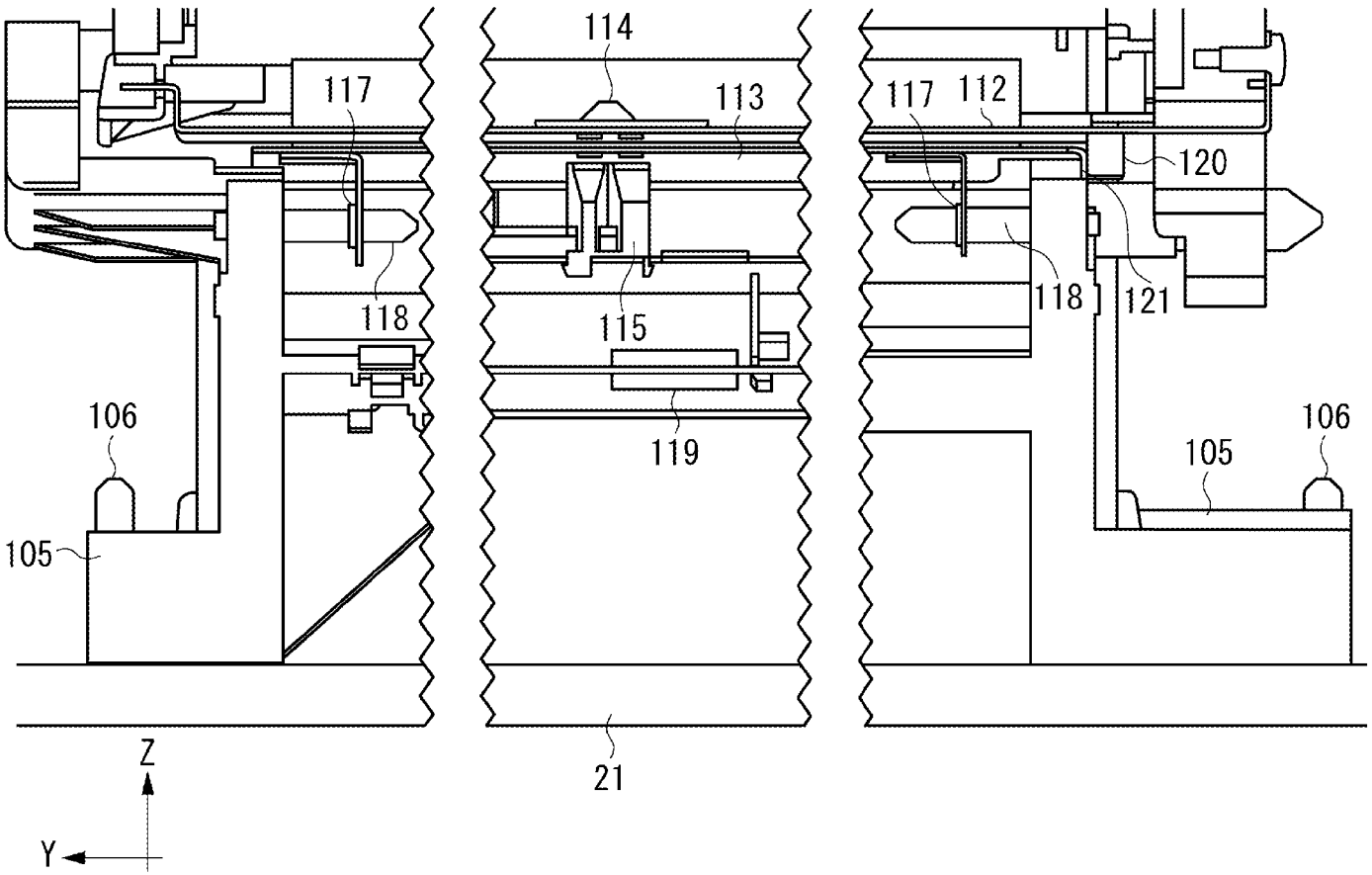
FIG. 10 is a structural view illustrating the secondary pre-transfer upper guide and the secondary pre-transfer lower guide according to the first exemplary embodiment.

FIG. 10 is a cross-sectional view, viewed from the registration portion 116, illustrating the secondary transfer portion 2 which includes the secondary pre-transfer upper guide and the secondary pre-transfer lower guide.

FIGS. 7A and 7B are cross-sectional views in which the secondary pre-transfer upper guide and the secondary pre-transfer lower guide are extracted. FIG. 7A is a diagram illustrating when the conveyance frame is stored, and FIG. 7B is a diagram illustrating when the conveyance frame is drawn.

The conveyance frame is configured to be drawable in the rotational axis direction (the Y direction) of the transfer roller.

The secondary pre-transfer lower guide 113 has a slide portion 117 at each end in the Y direction. In order that this slide portion 117 engages with a slide shaft 118, which protrudes from the secondary transfer outer unit 1, and is slidable in the Y direction, the secondary pre-transfer lower guide 113 is positioned relative to the secondary transfer outer unit 1 in the X and Z directions.

Moreover, the secondary pre-transfer lower guide 113 is urged in the -Y direction (the direction of a second contact portion) by a slide spring (a pressure member) 119.

The secondary pre-transfer upper guide 112 is mounted to be fixed in the X, Y, and Z directions relative to the intermediate transfer belt unit 3, which is supported by the image forming apparatus main body.

In addition, a check pin 120 protrudes from the pre-transfer upper guide 112 on the rear side in the Y direction.

When the conveyance frame 21 is pushed into the image forming apparatus from a state in which the conveyance frame 21 is drawn from the image forming apparatus, an abutting portion 121 of the secondary pre-transfer lower guide 113 on the rear side in the Y direction abuts the check pin 120 before the storage position. When the conveyance frame 21 is pushed further, the conveyance frame 21 is stored in the image forming apparatus and locked in the rear side plate 110 in a state in which the secondary pre-transfer lower guide 113 presses the secondary pre-transfer upper guide 112 by the slide spring 119.

A lock unit (a lock mechanism 126) includes a lock member 127 provided at the conveyance frame and a lock receiving portion 125 provided at the rear side plate 110. The lock member 127 engages with the lock receiving portion 125, and thus, the conveyance frame 21 is prevented from moving from the storage position due to the force of the slide spring 119.

By so doing, the secondary pre-transfer lower guide 113 is positioned in the Y direction relative to the secondary pre-transfer upper guide 112.

With such positioning structure, each of the accuracy of relative positions of the secondary pre-transfer lower guide 113 relative to the secondary pre-transfer upper guide 112 can be ±0.5 mm in the X, Y, and Z directions. The accuracy of relative positions in the X, Y, and Z directions can be less than or equal to ±1 mm, which is the necessary accuracy of relative positions.

Due to the above structure, the timing of which the recording material passes through can be detected using the retroreflective detection member having high resolution.

Here, the secondary pre-transfer upper guide 112 and the secondary pre-transfer lower guide 113 according to the present exemplary embodiment are made of metal. To prevent the occurrence of electrostatic noise and the leakage of a transfer current via the sheet material S, it is necessary to electrically ground the secondary pre-transfer upper guide 112 and the secondary pre-transfer lower guide 113 via an electric resistant member, such as a varistor or Zener diode. The secondary pre-transfer upper guide 112 is grounded via a resistive element from the intermediate transfer belt unit 3 by a not illustrated earth wire.

In addition, the check pin 120 of the secondary pre-transfer upper guide 112 is also made of metal. The secondary pre-transfer lower guide 113 is electrically connected to the secondary pre-transfer upper guide 112 at the abutting portion 121 via the check pin 120.

Therefore, the above-described structure makes it possible to ground the secondary pre-transfer lower guide 113 without requiring any earth wire or extra contact point.

Further, in the detection member described in the present exemplary embodiment, the prism portion 114 is mounted on the secondary pre-transfer upper guide 112, and the light emitting/receiving portion 115 is mounted on the secondary pre-transfer lower guide 113. However, the prism portion 114 may be mounted on the secondary pre-transfer lower guide 113, and the light emitting/receiving portion 115 may be mounted on the secondary pre-transfer upper guide 112.

Furthermore, in the present exemplary embodiment, the retroreflective detection member having the prism portion and the light emitting/receiving portion is used. However, it is possible to employ a structure, in which a light emitting detection member and a light receiving detection member are oppositely disposed.

(Description of Operation of Leading-edge Registration Control)

Figure 11:
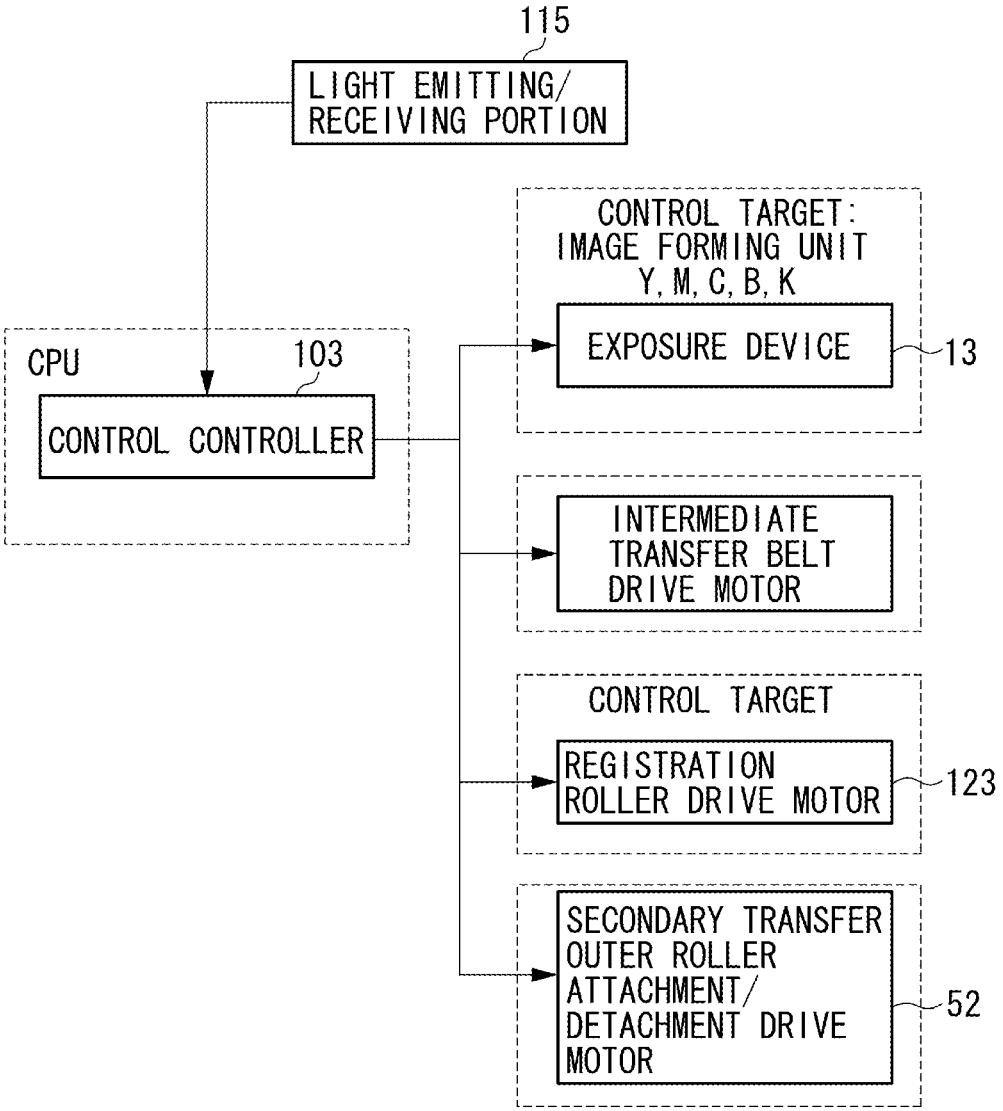
FIG. 11 is a block diagram illustrating leading-edge registration control.
Figure 12:
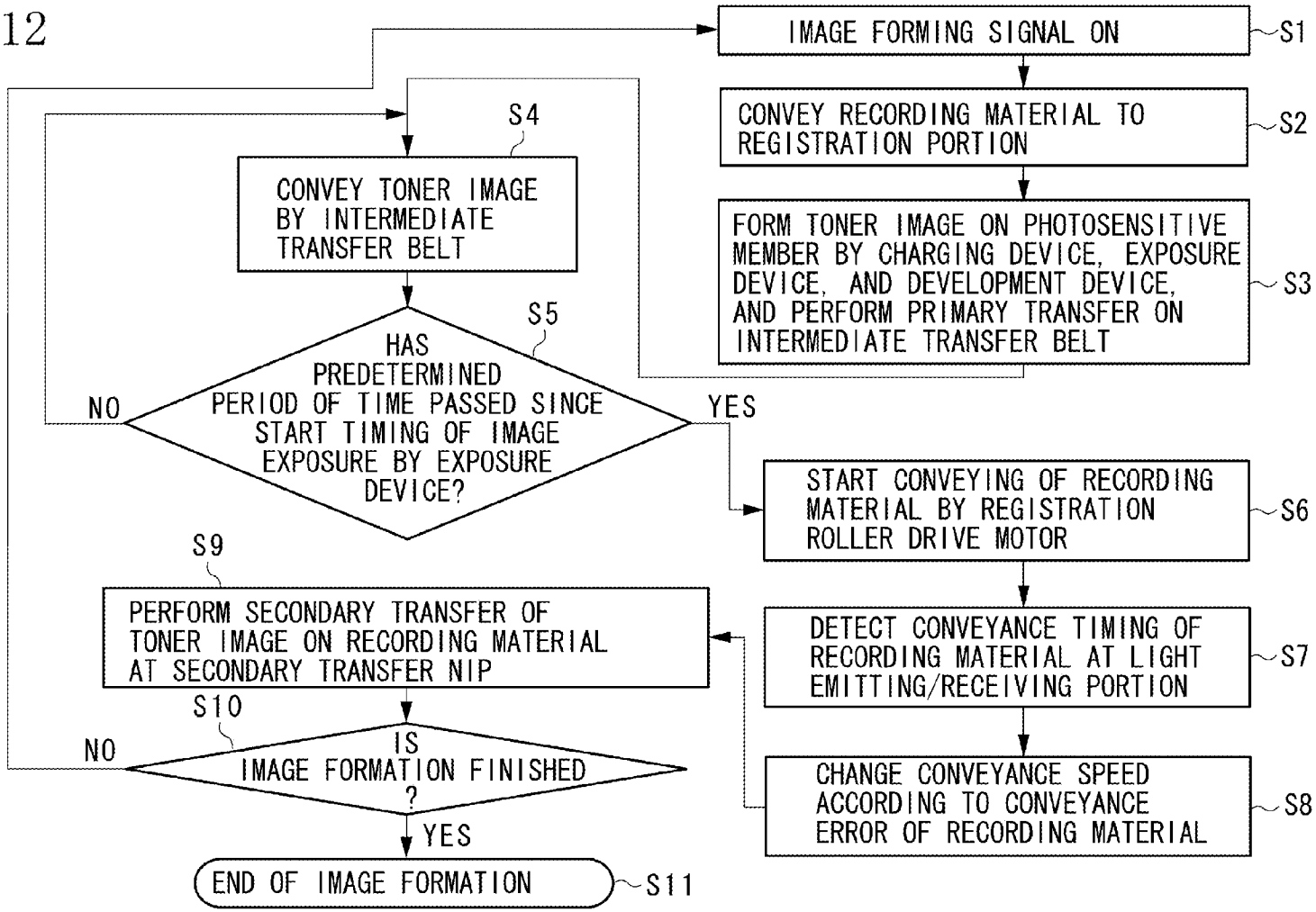
FIG. 12 is a flowchart illustrating the leading-edge registration control.

Here, the operation of leading-edge registration control using the aforementioned detection member will be described. FIG. 11 is a block diagram illustrating the leading-edge registration control. FIG. 12 is a flowchart illustrating the leading-edge registration control.

When, in step S1, a control controller 103 turns ON an image forming signal, then in step S2, a recording material is conveyed to the registration portion 116.

Next, in step S3, a toner image is formed on the photosensitive member by a charging device, an exposure device, and a development device, and primary transfer of the toner image is performed on the intermediate transfer belt by a primary transfer unit.

Then, in step S4, the toner image on the intermediate transfer belt is conveyed to the secondary transfer portion (the transfer portion) 2.

Subsequently, in step S5, the control controller 103 determines whether a predetermined period of time has passed since the timing of which image exposure is started by the exposure device.

In the present exemplary embodiment, the predetermined period of time is set according to the timing of which the image exposure is started. However, it should be noted that the reference is not limited to the timing of which the image exposure is started, and that the reference may include the timing of which the image forming signal is started, the timing of which rotation of the photosensitive member is started, or the like.

If the control controller 103 determines that the predetermined period of time has passed (YES in step S5), then in step S6, the control controller 103 starts to rotate the registration roller 75 to convey the recording material.

Here, when the recording material conveyed to the registration portion 116 is stopped temporarily, the stop position of the recording material varies due to the following causes.

The causes of variation include the difference in conveyance resistances due to the types of recording materials, the difference in conveyance forces due to the thicknesses of recording materials, and further, durability of the conveyance roller, fluctuations of conveyance amounts due to the sequential changes in a conveyance roller diameter, or the like.

Variation in conveyance of the registration roller 75 is added to this variation in the stop position. Consequently, misalignment of a leading-edge registration, which is misregistration of the toner image and the recording material in the conveyance direction, occurs.

Next, in step S7, the detection member of the control controller 103 detects timing at which the recording material before the secondary transfer passes.

Then, in step S8, based on the output of the detection member, the control controller (the correction unit) 103 changes the drive speed (the conveyance speed of the recording material) of a registration roller drive motor 123.

Next, in step S9, the toner image is transferred to the recording material at the secondary transfer portion (image formation by the image forming unit).

If the image formation is finished (Yes in step S10), then in step S11, the image formation is ended.

If the image formation is continued (NO in step S10), the aforementioned operations are repeatedly performed.

Misalignment of the leading-edge registration is corrected according to the above-described operations.

By including the structure described in the present exemplary embodiment, the image forming apparatus, in which adjustment of the relative positions of the detection members mounted on different units to oppose each other is not required at the time of assembling, or at the time of replacing the units or the detection members, may be provided.

Next, a structure of a second exemplary embodiment of the present invention will be described.

In the present exemplary embodiment, a secondary pre-transfer upper guide (a first recording material guide) is supported to be slidable to an intermediate transfer belt unit (a first unit) in the Y direction. The present exemplary embodiment is different from the first exemplary embodiment in that a second pre-transfer lower guide (a second recording material guide) is fixed to a secondary transfer outer unit in the X, Y, and Z directions.

The other structures are the same as those of the first exemplary embodiment, and descriptions of the other structures are not repeated to eliminate redundancy.

Figure 13:
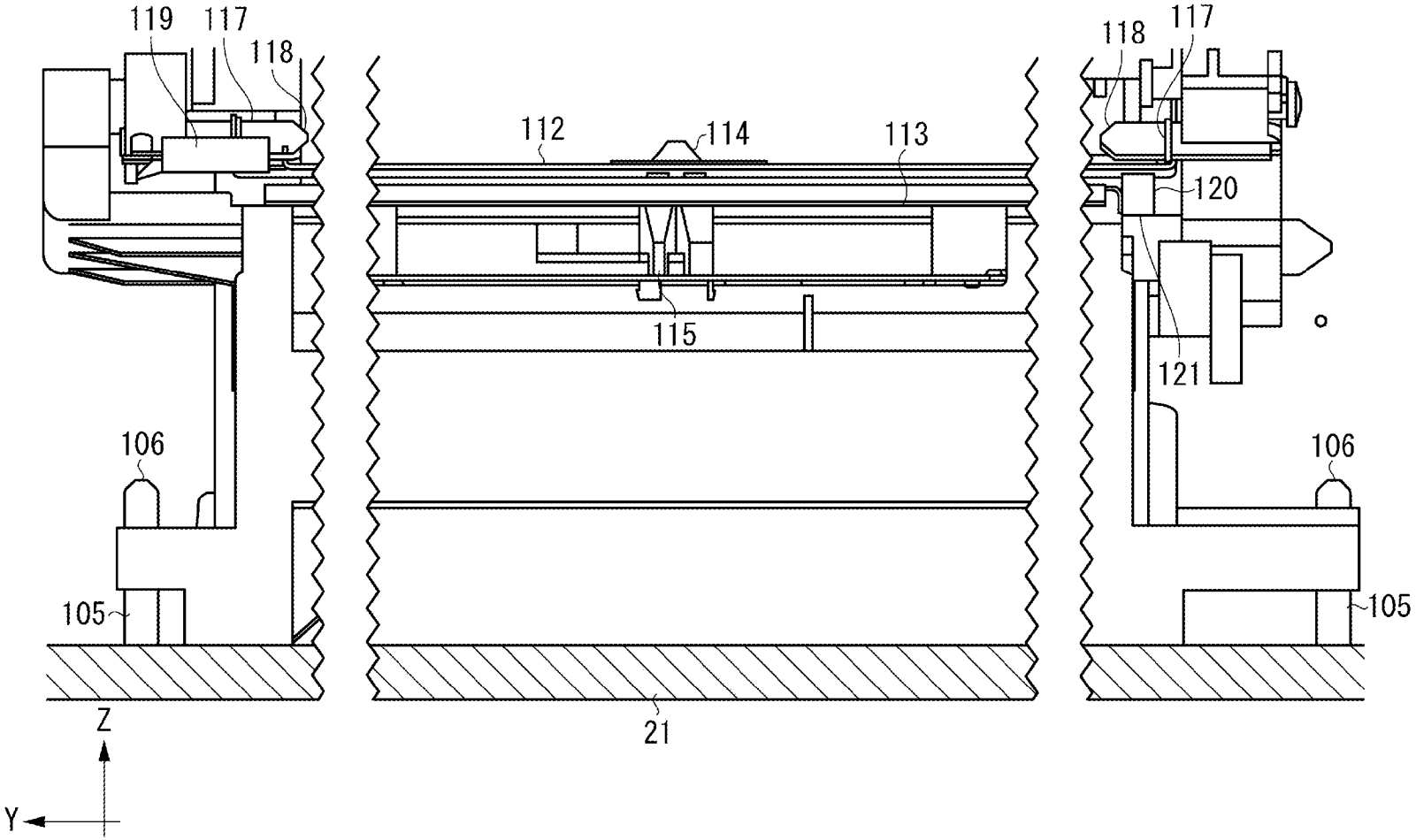
FIG. 13 is a structural view illustrating a secondary pre-transfer upper guide and a secondary pre-transfer lower guide according to a second exemplary embodiment.

FIG. 13 is a cross-sectional view illustrating an intermediate transfer belt unit 3 and a secondary transfer outer unit 1 according to the second exemplary embodiment.

Figure 14A:
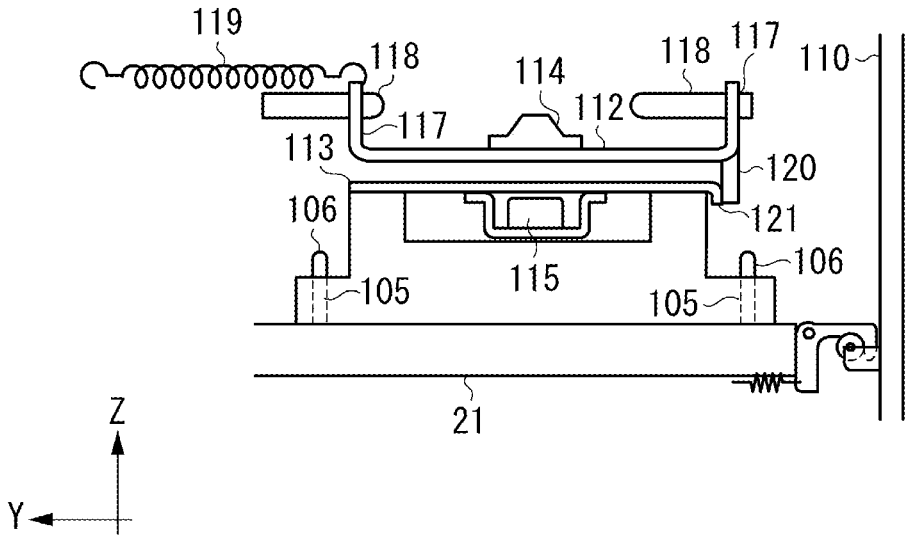
FIGS. 14A and 14B are structural views illustrating the secondary pre-transfer upper guide and the secondary pre-transfer lower guide according to the second exemplary embodiment.
Figure 14B:
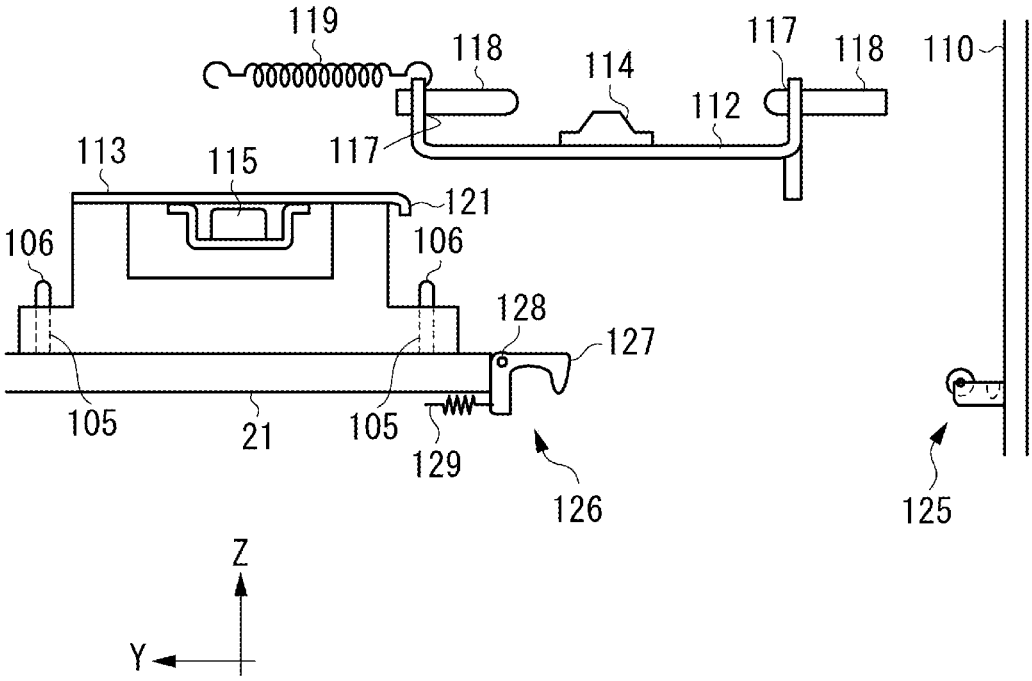

FIGS. 14A and 14B are cross-sectional views mainly illustrating the secondary transfer outer unit 1 according to the second exemplary embodiment. FIG. 14A is a diagram illustrating when a conveyance frame is mounted, and FIG. 14B is a diagram illustrating when the conveyance frame is drawn.

In the present exemplary embodiment, respective positioning structures of the intermediate transfer belt unit 3, the secondary transfer outer unit 1, and the conveyance frame 21 are similar to those of the first exemplary embodiment. A detection member for leading-edge registration control and used to detect timing at which a recording material passes includes also a retroreflective detection member similar to that of the first exemplary embodiment. A prism portion 114 is mounted on a secondary pre-transfer upper guide 112, and a light emitting/receiving portion 115 is mounted on a secondary pre-transfer lower guide 113.

The secondary pre-transfer upper guide 112 includes a slide portion 117 at each end in the Y direction. This slide portion 117 engages with a slide shaft 118, which protrudes from the intermediate transfer belt unit 3. Then, the secondary pre-transfer upper guide 112 is positioned relative to the intermediate transfer belt unit 3 in the X and Z directions to be movable in the Y direction.

In addition, a check pin (a first contact portion) 120 protrudes from the rear side of the pre-transfer upper guide 112 and is urged by a slide spring 119.

The secondary pre-transfer lower guide 113 is mounted on the secondary transfer outer unit 1 to be fixed in the X, Y, and Z directions.

When the conveyance frame 21 is mounted on an image forming apparatus main body, an abutting portion (a second contact portion) 121 of the secondary pre-transfer lower guide 113 on the rear side in the Y direction abuts the check pin 120. The second pre-transfer upper guide 112 is positioned in the Y direction relative to the secondary pre-transfer lower guide 113.

Further, in the detection member illustrated in the present exemplary embodiment, the prism portion 114 is mounted on the secondary pre-transfer upper guide 112, and the light emitting/receiving portion 115 is mounted on the secondary pre-transfer lower guide 113. However, the prism portion 114 may be mounted on the secondary pre-transfer lower guide 113, and the light emitting/receiving portion 115 may be mounted on the secondary pre-transfer upper guide 112.

Furthermore, in the present exemplary embodiment, the retroreflective detection member including the prism portion and the light emitting/receiving portion is used. However, it is possible to employ a transmissive detection member, in which a light emitting detection member and a light receiving detection member are oppositely disposed.

Next, a structure of a third exemplary embodiment of the present invention will be described.

The present exemplary embodiment is applied to an image forming apparatus of a monochrome copying machine using a photosensitive member instead of the intermediate transfer belt according to the first and the second exemplary embodiments.

Figure 15:
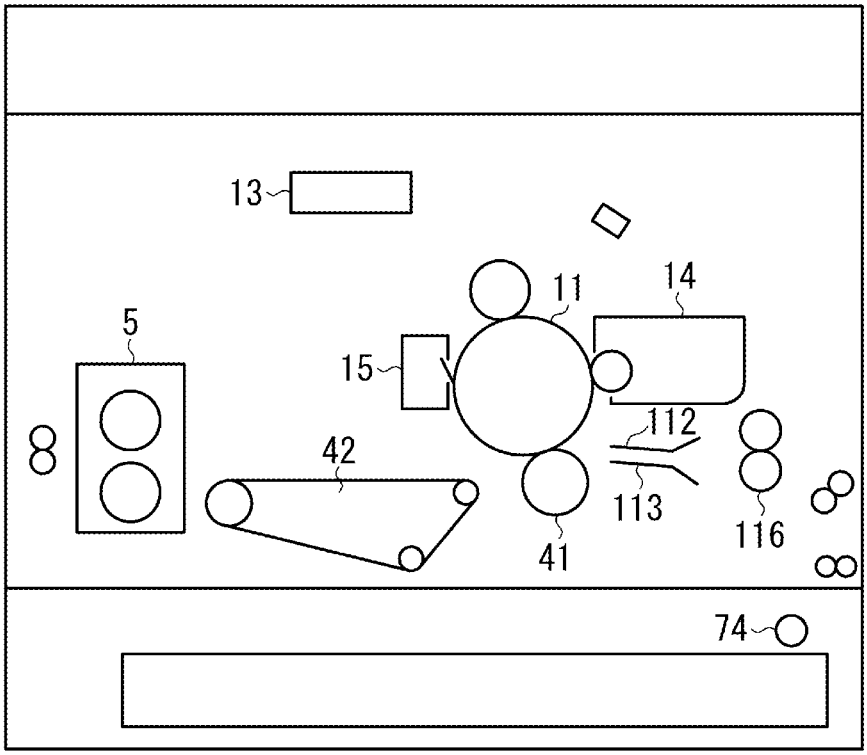
FIG. 15 is a cross-sectional view illustrating an image forming apparatus according to a third exemplary embodiment.
Figure 16:
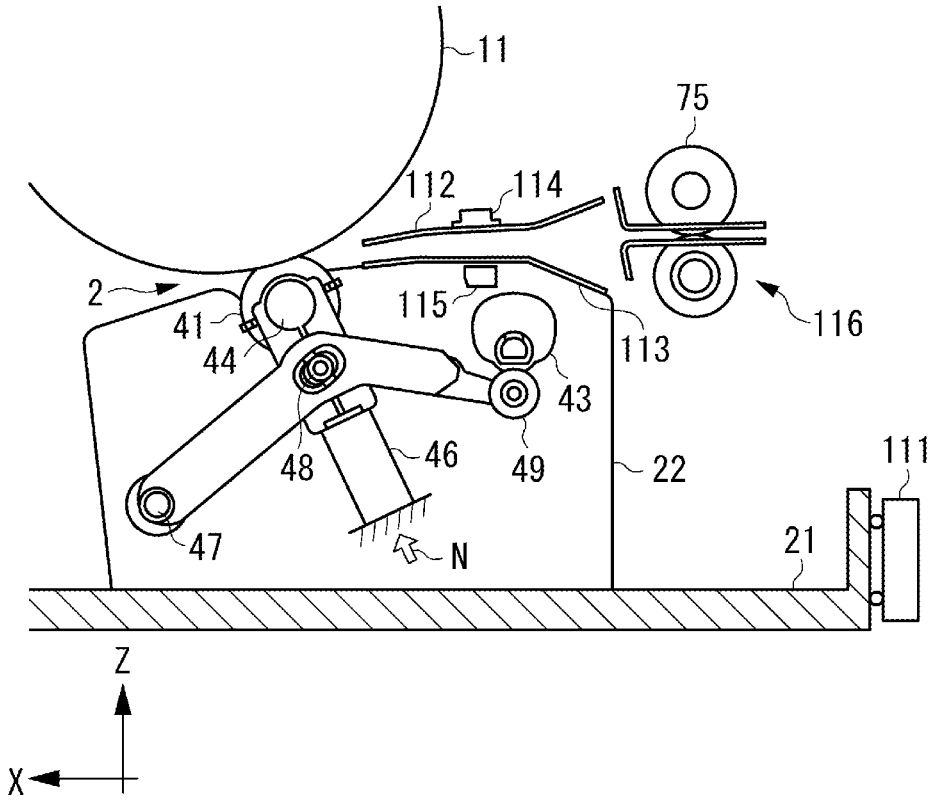
FIG. 16 a cross-sectional view illustrating a vicinity of a secondary transfer portion according to the third exemplary embodiment.

FIG. 15 is a cross-sectional view illustrating an image forming apparatus according to the third exemplary embodiment, and FIG. 16 is a cross-sectional view illustrating a vicinity of a secondary transfer portion according to the third exemplary embodiment.

In the third exemplary embodiment, a transfer roller 130 contacts a photosensitive member 11 and forms a secondary transfer portion (transfer portion). A pre-transfer upper guide 132 is provided on a main body side and a pre-transfer lower guide 133 is provided on a transfer unit side. A first detection portion is provided at the pre-transfer upper guide 132, and a second detection portion is provided at the pre-transfer lower guide 133.

A positioning structure is similar to that of the first exemplary embodiment.

By including the structure described in the present exemplary embodiment, the image forming apparatus, in which adjustment of the relative positions of the detection members mounted on different units to oppose each other is not required at the time of assembling, or at the time of replacing the units or the detection members, may be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-103805 filed Apr. 27, 2012, which is hereby incorporated by reference herein in its entirety.

What is claimed is:

1. An image forming apparatus comprising:

a first unit configured to transfer a toner image to a recording material at a transfer portion;

a feeding member configured to feed the recording material toward the transfer portion;

a guide member configured to guide the recording material fed by the feeding member to the transfer portion, the guide member including a first guide provided at the first unit and a second guide provided at a second unit drawable to an exterior of an image forming apparatus main body, the second guide being disposed at a position opposite the first guide and guiding the recording material;

a detection member disposed on an upstream side of the transfer portion in a feeding direction of the recording material and configured to detect timing at which the recording material passes, the detection member including a first detection portion provided at the first guide and a second detection portion provided at the second guide;

a speed setting member configured to set a conveyance speed of the recording material according to a result of detection by the detection member;

a lock member configured to lock the second unit stored in the image forming apparatus at a position within the image forming apparatus main body; and a pressure member configured to press the first guide and the second guide to each other when the second unit is locked within the image forming apparatus main body.

2. The image forming apparatus according to claim 1, wherein the first guide is slidably provided at the first unit and is pressed in a slide direction by the pressure member.

3. The image forming apparatus according to claim 1, wherein the second guide is slidably provided at the second unit and is pressurized in a slide direction by the pressure member.

4. The image forming apparatus according to claim 1, wherein one of the first detection portion and the second detection portion includes a prism and the other of the first detection portion and the second detection portion includes a light emitting/receiving portion.

5. The image forming apparatus according to claim 1, wherein one of the first detection portion and the second detection portion includes a light emitting portion and the other of the first detection portion and the second detection portion includes a light receiving portion.

6. The image forming apparatus according to claim 1, wherein the first unit includes an intermediate transfer member configured to bear the toner image.

7. The image forming apparatus according to claim 6, wherein the second unit includes a transfer roller configured to transfer the toner image on the intermediate transfer member to the recording material at the transfer portion.

8. The image forming apparatus according to claim 7, wherein the second unit is drawn to the exterior of the image forming apparatus body in a rotational axis direction of the transfer roller.

9. The image forming apparatus according to claim 1, wherein the guide member is electrically conductive, and at least one of the first guide and the second guide is grounded via an electrical resistive member.

* * * * *